US008465230B1

(12) United States Patent
O'Reilly

(10) Patent No.: US 8,465,230 B1
(45) Date of Patent: Jun. 18, 2013

(54) SILT FENCE SUPPORT

(76) Inventor: Paul D. O'Reilly, Oxford, MA (US)

( * ) Notice: Subject to any disclaimer, the term of this patent is extended or adjusted under 35 U.S.C. 154(b) by 93 days.

(21) Appl. No.: 12/931,003

(22) Filed: Jan. 20, 2011

(51) Int. Cl.
*E02D 17/20* (2006.01)

(52) U.S. Cl.
USPC ..... 405/302.6; 405/302.4; 405/302.7

(58) Field of Classification Search
USPC ..... 405/46, 110, 118, 124, 302.4, 302.6, 405/302.7; 256/65.15
See application file for complete search history.

(56) References Cited

U.S. PATENT DOCUMENTS

| | | | | |
|---|---|---|---|---|
| 954,283 | A | 4/1910 | Hawkes | |
| 972,059 | A | 10/1910 | Clarke | |
| 1,230,608 | A | 6/1917 | Sheldon | |
| 2,069,715 | A | 2/1937 | Arpin | |
| 3,733,831 | A * | 5/1973 | Sticker, Jr. | 405/30 |
| 3,888,209 | A | 6/1975 | Boots | |
| 4,031,676 | A | 6/1977 | Dally | |
| 4,279,535 | A | 7/1981 | Gagliardi et al. | |
| 4,756,511 | A | 7/1988 | Wright, III | |
| 4,998,844 | A * | 3/1991 | Mouton et al. | 405/21 |
| 5,405,217 | A | 4/1995 | Dias et al. | |
| 5,605,416 | A | 2/1997 | Roach | |
| 5,758,868 | A | 6/1998 | Shea | |
| 6,334,736 | B1 | 1/2002 | Johnson et al. | |
| 6,361,248 | B1 * | 3/2002 | Maestro | 405/49 |
| 6,540,445 | B1 | 4/2003 | Evans, Jr. | |
| 7,008,143 | B1 | 3/2006 | Wolfe | |
| 7,157,010 | B1 | 1/2007 | Wolfe | |
| 7,374,154 | B2 * | 5/2008 | Platt | 256/65.01 |
| 7,736,097 | B2 | 6/2010 | D'Andreta et al. | |
| 2004/0156680 | A1 | 8/2004 | Gibbs | |
| 2008/0315169 | A1 | 12/2008 | McNeill | |
| 2009/0022552 | A1 | 1/2009 | Berenyi | |
| 2010/0158617 | A1 | 6/2010 | Mahan | |

* cited by examiner

*Primary Examiner* — David Bagnell
*Assistant Examiner* — Benjamin Fiorello
(74) *Attorney, Agent, or Firm* — John P. McGonagle

(57) ABSTRACT

A silt fence support base comprised of a porous casting made of stone, cement and water, and having a half-moon shape. Each casting may have one or more openings for the insertion of posts, which provide a frame for holding porous, filter material. Silt fence filtering material may be anchored under the bases.

1 Claim, 1 Drawing Sheet

SILT FENCE SUPPORT

BACKGROUND OF THE INVENTION

This invention relates to fences, and more particularly to a silt fence support.

Construction often disturbs trees, grasses, bushes and other elements, which naturally control run-off, water, sediment and erosion, and result in unprotected banks of soil. Typically, the bare earth is exposed in a construction site, which, if no controls are implemented, causes significant erosion and other water damage can occur. When unprotected banks are subjected to water flow, as during a rain storm, the run-off of ground water carries with it substantial amounts of silt, fine soil, stones and the like. This action results in erosion of the banks and, in addition, causes the file particles to flow along with the water causing contamination of streams, ponds, private property and vegetation.

Silt fences are used as barriers to sediment, particularly in connection with preventing soil erosion at construction sites. Silt fences prevent sediments carried by un-channeled flow, or sheet flow, from rainwater from leaving a ground site and either entering natural drainage channels or entering waste and storm drain systems. Un-channeled surface water that is deposited upon ground having a sloped surface moves by gravity directed flow along paths determined by the contour of the ground surface. Typically, a silt fence is installed along a path spanning the sloped ground surface or along a path spanning beneath such a slope. The installation path is selected such that it is transverse to the water flow path and impedes the flow. The barriers slow the runoff sheet flow and frequently create a ponding of water upstream of the silt fence. The reduction in water velocity causes the larger entrained soil particles to settle to the ground surface upstream of the silt fence. A silt fence provides a filtration barrier that filters suspended silt particles as the low velocity of ponded water passes through the silt fence to form an effluent stream. The filtered silt particles are shed from the vertical fabric barrier surface or the standard silt fence and accumulate at its base. The size of openings in the barrier determines the size of the particles filtered. The size, shape and number of openings, as well as the height of the ponded water, determine flow rate of the filtered effluent stream.

A wide variety of materials and structures are used in sediment control barriers. Sediment control barriers include silt fences constructed of filtering fabrics, support posts and wire fences. Conventional silt fences are constructed of flexible plastic material attached to wooden stakes, which are driven into the ground. However, this construction generally does not have the structural strength to collect soil and sediment, and is susceptible to adverse effects produced by the wind. The wind causes the fencing material to pull at the attachment and eventually it becomes torn and does not function for the purposes intended.

Another type of sediment and erosion control device uses a base comprised of hay or straw bales. However, hay bales are seldom satisfactory. Firstly, they are difficult to install. The weight and associated factors of hay bales make installation a labor-intensive task. Secondly, long wooden or steel stakes must be used to hold the bales in place. These are expensive and difficult to install and remove. Thirdly, quality control for hay or straw bales is very seldom available, resulting in a poor quality material often being used. Fourthly, hay or straw bales become soil laden very quickly and cannot be reused. The bales disintegrate in a relatively short period of time. They are then difficult to remove. Finally, hay bales are not readily available in some areas and, due to their weight and bulkiness, cannot be shipped to these areas in a cost-efficient manner.

SUMMARY OF THE INVENTION

The present invention overcomes the limitations of prior art silt fences by providing a silt fence support base comprised of a porous casting made of stone, cement and water, and having a half-moon shape. Each casting may have one or more openings for the insertion of posts, which provide a frame for holding porous, filter material. Under most circumstances the invention bases do not require staking. Silt fence filtering material can be anchored under the bases. Water can pass through the porous invention bases. The invention bases may be re-used and can be stacked for shipping. The present invention castings can be manufactured on dry cast machines.

These together with other objects of the invention, along with various features of novelty, which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
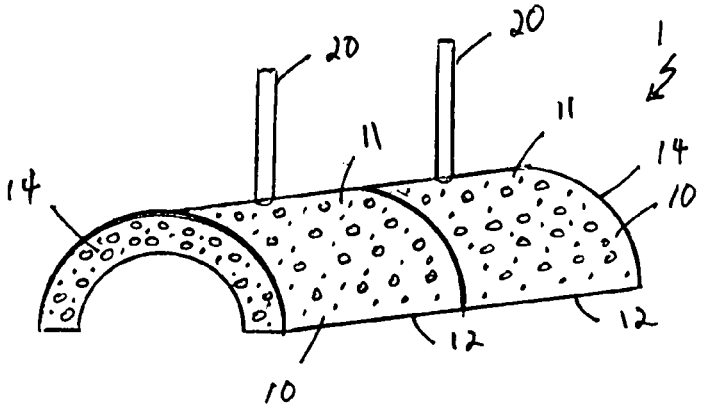
FIG. 1 is a front perspective view of two silt fence bases, side-by-side.
Figure 2:
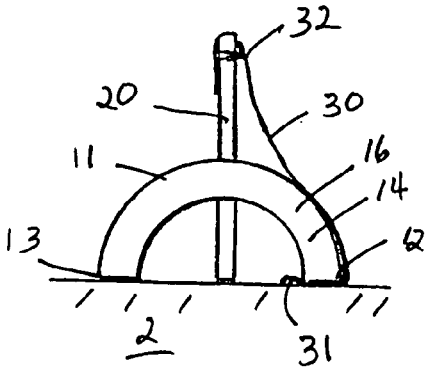
FIG. 2 is an end view of a base with a filter membrane attached.

Referring to the drawings in detail wherein like elements are indicated by like numerals, there is shown a silt fence base 1 according to the present invention. The base 1 is comprised of a hollow, semi-cylindrical base element 10 having a convex top 11 terminating at a forward bottom edge 12 and a rearward bottom edge 13. The base element 10 has two open, opposite sides 14 defining a base longitudinal axis. The base element top 11 has a central aperture 15 formed therein, equidistance from the base element sides 14.

The base element 10 is comprised of a mixture of cement, stone and water formed into a hollow, semi-cylindrical, porous concrete casting, preferably by means of a dry cast machine. Sand is specifically excluded from the casting to keep the casting porous. The size of the stone used affects the base element filtering rate. The base element 10 is used in conjunction with a post 20 inserted through the base element top, aperture 15. The post 20 is preferably made from wood or plastic, and will generally have an approximate two inch diameter.

Figure 3:
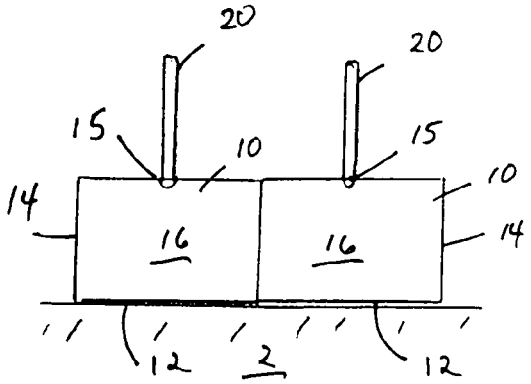
FIG. 3 is a front view of the two bases of FIG. 1.
Figure 4:
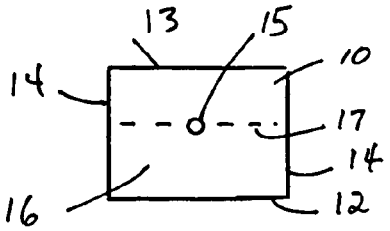
FIG. 4 is a top view of a silt fence base.

In use a plurality of base elements 10 are laid side by side along a desired path, resting on the ground 2. See, for example, FIGS. 1 and 3. The base element front bottom edges 12 face the silt-laden, water flow. A generally rectangular filter membrane 30 is laid across the base element front surface 16, i.e., that portion of the base element extending from a top central axis 17 to the forward bottom edge 12. The filter membrane 30 has one side 31 tucked beneath each base element bottom edge 12. The filter membrane has an opposite side 32 is attached to the posts 20.

The base element 10 has a nominal longitudinal length of twelve inches. The radius or height of the base element is a nominal nine inches. The diameter or distance between the forward and bottom edges 12, 13 is a nominal eighteen inches. The base element thickness is approximately three inches leaving a nominal open diameter space beneath the base element of twelve inches in width and six inches in height. To make a casting of these nominal dimensions, three and a third gallons of three-quarter inch stone, one gallon of cement, and one-half gallon of water are used. Although the nominal dimensions are preferred because of ease of handling and shipping, other dimensions with corresponding changes in content and stone size can be made. Also, if longer longitudinal sizes are desired, a plurality of apertures may be formed in the base element top 11.

It is understood that the above-described embodiment is merely illustrative of the application. Other embodiments may be readily devised by those skilled in the art which will embody the principles of the invention and fall within the spirit and scope thereof.

I claim:

1. A silt fence support adapted to rest on a desired ground for holding a silt fence, comprising:

a semi-cylindrical base element having a convex top terminating at a forward bottom edge and a rearward bottom edge, said base element having two open, opposite sides defining a base longitudinal axis, said base element top having a central aperture formed therein, equidistance from the base element sides;

wherein the base element is comprised of a mixture of cement, stone and water formed into a hollow, semi-cylindrical, amorous concrete casting;

wherein the base element is used in conjunction with a post inserted through the base element top aperture;

wherein a plurality of base elements are adapted to being laid side by side along a desired path, resting on the ground, each said base element front bottom edges facing a silt-laden, water flow;

wherein a generally rectangular filter membrane is laid across a base element front surface comprised of a portion of the base element extending from a top central axis to the forward bottom edge, said filter membrane having one side tucked beneath each base element bottom edge, said filter membrane having an opposite side attached to the posts.

* * * * *